United States Patent [19]

Saito

[11] 4,340,450

[45] Jul. 20, 1982

[54] METHOD FOR PLATING ROLLERS AND APPARATUS FOR MOUNTING ROLLERS UTILIZED IN THE METHOD

[75] Inventor: Susumu Saito, Kashiwa, Japan

[73] Assignee: Shinku Laboratory Co., Ltd., Chiba, Japan

[21] Appl. No.: 167,108

[22] Filed: Jul. 9, 1980

[51] Int. Cl.[3] ..... C25D 5/34; C25D 7/04; C25D 17/06

[52] U.S. Cl. ..... 204/25; 204/215; 204/226

[58] Field of Search ..... 204/25, 212, 215, 225, 204/226

[56] References Cited

U.S. PATENT DOCUMENTS

| | | | |
|---|---|---|---|
| 3,244,613 | 4/1966 | Karlquist | 204/212 |
| 3,462,357 | 8/1969 | Karlquist | 204/212 |
| 3,660,265 | 5/1972 | Kangas | 204/25 |
| 3,664,944 | 5/1972 | Buckley | 204/212 |

*Primary Examiner*—T. Tufariello

*Attorney, Agent, or Firm*—Koda and Androlia

[57] ABSTRACT

A method for plating only the outer circumferential surface of a hollow roller which includes the steps of mounting the roller in a cassette, conveying the cassette to and mounting the cassette on a plating tank such that at least a part of the roller is immersed in the plating solution in the plating tank, rotating the roller while applying a plating current to the roller, dismounting the cassette from the plating tank, conveying the cassette to a roller removal location, and removing the roller from the cassette. The cassette includes a pair of lifting frames, a pair of rotary spindles facing each other and rotatably coupled to the lifting frames such that at least one of the spindles is axially movable, a pair of electrically conducting members provided one on each of the pair of spindles and capable of supporting the roller by engaging with the hollow ends of the roller and a pair of liquid leakage prevention caps provided one on each of the pair of spindles for preventing liquid from leaking to the inside of the roller when the cap engages with the hollow ends of the roller.

2 Claims, 2 Drawing Figures

METHOD FOR PLATING ROLLERS AND APPARATUS FOR MOUNTING ROLLERS UTILIZED IN THE METHOD

BACKGROUND OF THE INVENTION

1. Field of the Invention

This invention relates to methods for plating printing rollers and more particularly to plating of photogravure plates and to mounting apparatuses for such rollers utilized in the plating method.

2. Prior Art

In order to provide homogeneous plating of a gravure roller, at least a part of the roller surface must be immersed in a process solution and the roller must be rotated with precision at a specified constant rate. In addition, in order to carry out the plating in a short time period, it is desireable to immerse the whole body of the roller in the process solution. Consequently, because the gravure roller is hollow in shape, some action must be taken to prevent the process solution from leaking to the inside of the roller.

With such a necessity, in conventional plating processes for gravure plate making, action is taken as follows: a spindle is inserted through the hollow gravure roller; both ends of the roller are supported with a pair of ring shaped charge-supporters provided on the spindle; ring shaped leakproof caps are provided on the spindle to cover both of the charger-supporters and seal the ends of the roller; and the completed set-up is then mounted on a pretreatment apparatus, then mounted on plating apparatus, and then mounted on a after-treatment apparatus. However, in such a procedure, manual mounting is indispensable, and complete automatization has been hindered. Also, in such a process a great amount of man power is required and work efficiency is low.

In addition, in another conventional example, the Europena gravure plate maker is equipped with an apparatus to automatically mount the gravure roller onto the pretreatment apparatus, plating apparatus, and after-treatment apparatus or to dismount the roller from each of them respectively as well as to rotate the roller. However, such a structure has certain disadvantages as is described below. Firstly, the cost is high because an automatic mounting apparatus is required for each pretreatment, plating and after-treatment apparatus. In addition, the mounting must be done on each apparatus and therefore the time required for the process increases. In addition, since there are required a great number of mountings and dismountings of the roller, the chance of a leak into the inside of the roller is increased. Furthermore, because the roller is directly lifted onto and off of each one of the apparatuses, there is a substantial possibility that the roller surface will be scratched and to avoid such scratching the rollers must be handled carefully and with a soft material such as a cloth.

SUMMARY OF THE INVENTION

Accordingly, it is the general object of the present invention to overcome the disadvantages of the prior art.

In addition, it is a general object of the present invention to provide an apparatus wherein the printing roller can be mounted automatically and exactly.

It is another advantage of the present invention that it should provide an apparatus wherein the roller can be carried easily, quickly, and safely to a plurality of specified processing apparatuses without manually handling the roller.

It is yet another object of the present invention to provide an apparatus wherein each of the processing apparatuses is not required to have a mounting apparatus.

It is yet another object of the present invention to provide a method and apparatus for plating a roller wherein the cost is reduced.

In keeping with the principles of the present invention, the above-mentioned features and objects of the present invention are accomplished by a unique plating method for plating only the outer circumferential surface of a hollow roller. This method includes the steps of mounting the roller in a cassette wherein the cassette includes a pair of lifting frames, a pair of rotary spindles facing each other and rotatably coupled to the lifting frame such that at least one of the spindles are axially movable, a pair of electrically conductive members provided one on each of said pair of spindles capable of supporting said roller by engaging with hollow ends of the roller, and a pair of liquid leakage proof prevention caps provided one on each end of the pair of spindles for preventing liquid from leaking to the inside of said roller when the caps engage with the hollow ends of the roller, conveying the cassette to and mounting the cassette on a plating tank such that at least a part of the roller is immersed in a plating solution in the plating tank, rotating the roller while applying the plating current to the roller, dismounting the cassette from the plating tank, conveying the cassette to a roller removal location and removing the roller from the cassette.

BRIEF DESCRIPTION OF THE DRAWINGS

The above-mentioned features and objects of the present invention will become more apparent with reference to the following description taken in conjunction with the accompanying drawings, wherein like reference numerals denote like elements and in which.

DETAILED DESCRIPTION OF THE INVENTION

Figure 1:
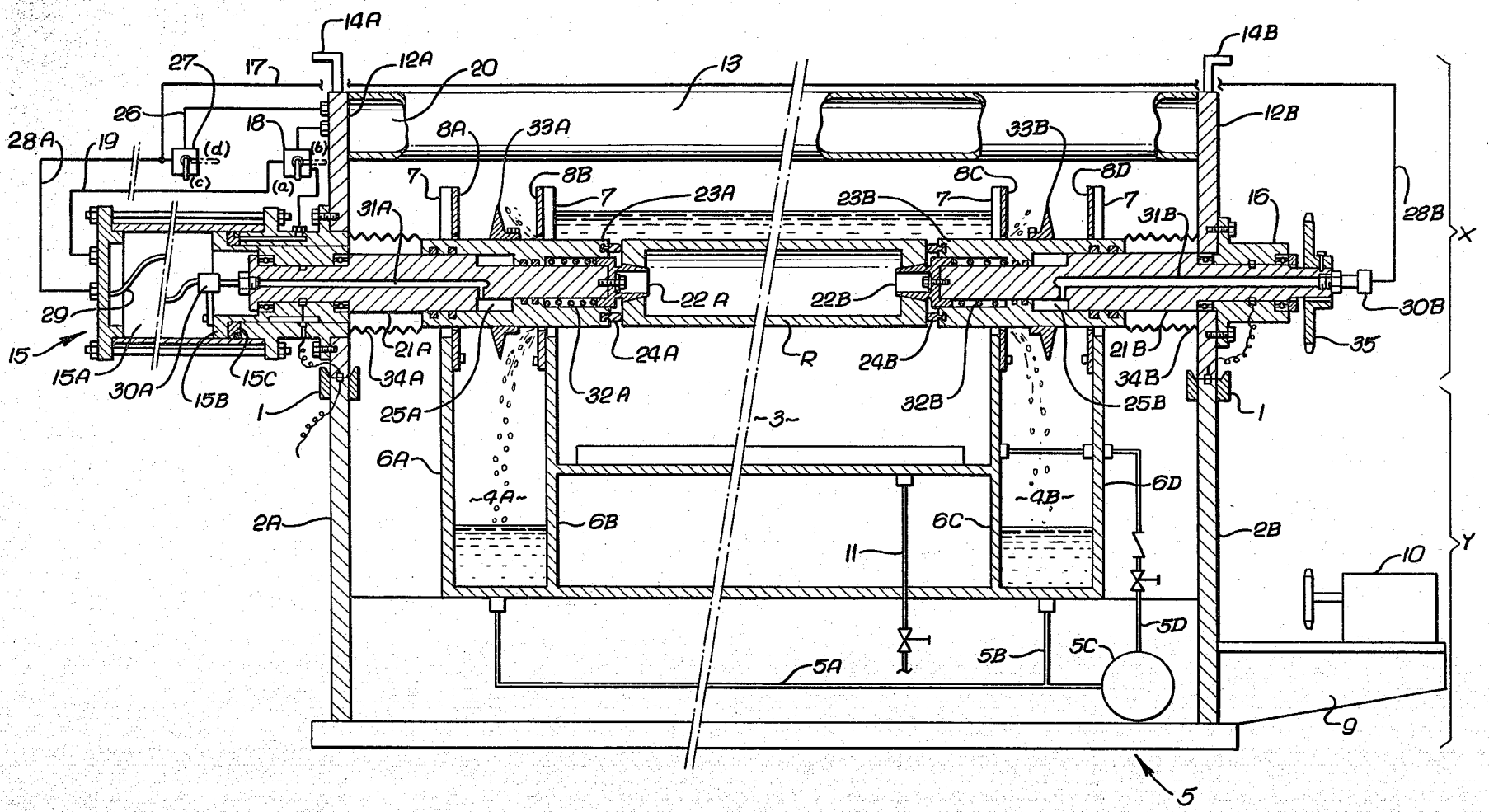
FIG. 1 is a sectional view of a mounting apparatus and plating apparatus in accordance with the teachings of the present invention.

Referring more particularly to the drawings, shown in FIG. 1 is a mounting apparatus represented by the symbol X and a copper plating apparatus represented by a symbol Y. The mounting apparatus X and the copper plating apparatus Y, operate together to perform the required function.

Firstly, an explanation will be given of the construction and operation of the copper plating apparatus Y. The apparatus Y includes a pair of right and left frames 2A and 2B which are provided with guide plates 1 at their upper ends in order to mount the apparatus X on to the specified position. Between the frames 2A and 2B is provided a process tank 3 and at both sides of the tank 3 is provided leakage collector tanks 4A and 4B. Any process solution in the collector tanks 4A and 4B which has leaked from process tank 3 is sent back to the process tank 3 through a circulator 5 composed of circulation pipes 5A and 5B, circulation pump 5C and circulation pipe 5D. On top of the four side panels 6A, 6B, 6C, and 6D, which constitute the above-described tanks 3, 4A and 4B, notches 7 are provided so that the apparatus X can be mounted thereon by fitting into the notches 7. In addition, leak prevention plates 8A, 8B, 8C, and 8D are provided. The lower ends of leak prevention plates 8A through 8D are pivoted and can close in order to prevent the process solution from leaking from the tank 3. However, the upper portions of the prevention plates 8A through 8D can be split in two. On an accessory board 9 attached to the right frame 2B, a motor 10 is installed. The motor 10 is designed to drive an appropriate chain drive which is not shown in the drawings. A drip trap 11 is provided under the process tank 3.

In the following paragraphs the mounting apparatus will be explained. The mounting apparatus X includes right and left vertical frames 12A and 12B which face each other and which cooperates with the right and left frames 2A and 2B of the apparatus Y. The frames 12A and 12B are designed to be placed on top of the frames 2A and 2B and are installed at both ends of the high pressure tank 13. The high pressure tank 13 also serves as the transverse frame member. As a whole, all of these components form a hoasting frame. The pressure in the high pressure tank 13 can be detected by means of a pressure gage, not shown. Also, the tank 13 can regularly supply high pressure air through an air inlet attached to it, but not shown in the drawings. Furthermore, on upper sides of both ends of the tank 13 is provided suspension metal fittings 14A and 14B.

At the lower end of the left of the tank 13 vertical frame 12A and air cylinder unit 15 is provided. At the lower end of the right tank 13, vertical frame 12B and cylinder bearing box 16 is provided. The air cylinder unit 15 is designed to conduct the pressurized air in the high pressure tank 13 into the outlet side of the cylinder chamber 15A through the pipe 17, switching valve 18, and pipe 19 to push the piston 15B made of insulated material towards the right frame 12B. Also, the air cylinder unit 15 is designed that by switching the switching valve 18 from (a) to (b), the pressurized air in the high pressure tank 13 is led to the retreating side cylinder chamber 15C through the pipe 20 and the piston 15B is pulled back. The piston 15B is made in a cylindrical shape. To the piston 15B, the bearing box 16, spindles 21A and 21B are rotatably coupled and the pair of spindles 21A and 21B face each other. Charge-supporters 22A and 22B are fastened to respective ends of the spindles 21A and 21B. These charge-supporters 22A and 22B have tapered cylinders capable of anchoring the printing roller R.

At the outside of the spindles 21A and 21B, leakproof caps 23A and 23B are fitted in a manner as to be able to slide. At the end surfaces of the leakproof caps 23A and 23B, ring shaped packings 24A and 24B are provided. In order to enable a pair of right and left leakproof caps 23A and 23B to approach each other by moving their positions respectively, the cylinder chambers 25A and 25B are provided between a notched portion of an inner surface of the leakproof caps and a notched portion of the spindles 21A and 21B, respectively. Into the left cylinder chamber 25A, highly pressurized air from the high pressure tank 13 is provided via the pipe 26, the switching valve 27, the pipe 28A, the flexible pipe 29 installed on the cylinder 15A, the rotary joint 30A, and the air inlet 31 provided in the spindle 21A. Also, into the right cylinder chamber 25B, the highly pressurized air is provided via the pipe 28A, rotary joint 30B, and air inlet 31B provided through the spindle 21B.

Between the respective leakproof caps 23A and 23B, and the small diameter portions of the spindles 21A and 21B, springs 32A and 32B are inserted and by switching the switching value 27 from (c) to (d), the respective leakproof caps are carried back to the original position by the springs 32A and 32B. At the outside of the respective leakproof caps 23A and 23B, hand guard shaped drainboards 33A and 33B are installed in such a position that they are provided between the side panel 6A and 6B and 6C and 6D, respectively. Between the leakproof cap 23A and the vertical frame 12A and between the leakproof caps 23B and the vertical frame 12B, the bellows shaped cylinders 34A and 34B are provided. Current feeding to the charger-supporters 22A and 22B is accomplished by feeding the current to bearing portions of the respective spindles 21A and 21B. In addition, at the base of the right spindle 21B, is provided a sprocket 35.

In operation to mount the roller R in the apparatus X one must first place the roller R on a supporting roll for mounting, not shown in the drawings. Then, after placing the apparatus X on the roller R, fit the tapered hole at the right end of the roller R over the tapered cylinder of the charger-supporter 22B on the right side by moving the roller R towards the right. Next, switch the lever of the switching valve 18 from (b) to (a). By doing so the piston 15A is pushed out and the charger-supporter 22A at the end of the left spindle 21A fits into the tapered hole at the left end of the roller R. Thereafter, when the lever of the switching valve is shifted from (b) to (c), high pressure air in the high pressure tank 13 flows into the right and left cylinder chambers 25A and 25B and the right and left leakproof caps 23A and 23B support the ends of the roller R as well as preventing the leakage of the process solution to be inside of the roller R.

To remove the roller R, it only required that the switching valve 27 be returned to the (d) position and then the switching valve 18 returns to the (b) position. The above-described mounting and dismounting of the roller R by the apparatus X is carried on a specified mounting or dismounting board and the roller is mounted onto the apparatus Y after being held by the apparatus X. Upon mounting the apparatus X with the roller R onto the apparatus Y, the four leak prevention plates 8A, 8B, 8C and 8D are split in two, respectively, by the action of the springs which are not shown in the drawings and are closed when the leakproof caps 23A and 23B are dropped into a setting position. Also, by merely mounting the apparatus X on the apparatus Y, the sprocket 35 of the apparatus X is linked to a chain drive gear (not shown) of the apparatus Y and the right spindle 21B is caused to rotate by the motor 10. Then, when the motor 10 and circulation pump 5C of the apparatus Y are started to operate automatically or manually, the roller R held at both ends with the right and left spindles 21A and 21B is immersed, while rotating, in the process solution in the processing tank 13 to be copper plated.

Figure 2:
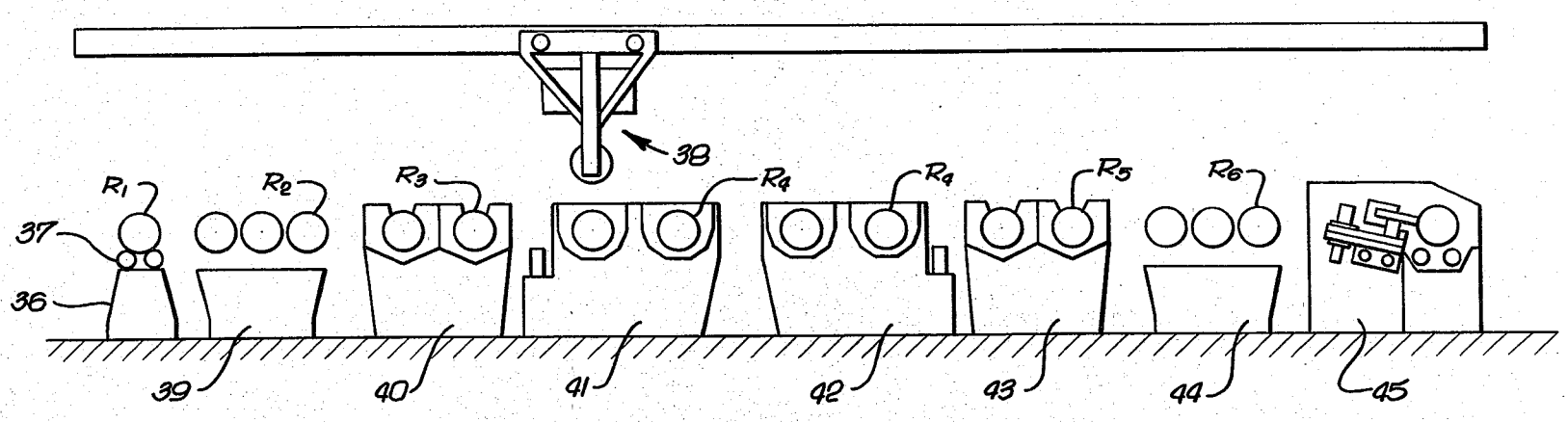
FIG. 2 is a schematic view of a plating process line utilizing the plating method in accordance with the teachings of the present invention.

Referring now to FIG. 2, shown therein is a method for plating the roller in a copper plating process line utilizing the mounting apparatus X described above. The roller R is mounted on two supporting rollers 37 provided on a mounting board 36 and to the roller R1 the apparatus X is fitted as is described above. Then, the apparatus X, which holds the roller R, is held by an automatic carrier 38 which is controlled by a computer and carried to the stop board 39 to be stored. Next, the rollers R2 assembled with the apparatus X and placed on the stop board 39 are carried to the pretreatment apparatus 40 by the carrier 38, after being divided into two groups of rollers and mounted on the apparatus 40. Then, the rollers are nickel plated and are subjected to treatment. When the pretreatment is completed, the rollers R3 assembled with the apparatus X are carried by the carrier or conveyor 38 to a double copper plating apparatus 41 and 42 wherein both of the rollers are mounted on the double copper plating apparatus 41 and 42 and copper plated. Next, the rollers R4 assembled with the apparatus X are carried separately to the after-treatment apparatus 43 and mounted on the after-treatment apparatus 43. When after-treatment is finished, the rollers R5 assembled with the apparatus X are carried by the carrier 38 to the stop board 44 and mounted thereon. Finally, the rollers are carried to a buffing machine 45 to be buffed and when the buffing is finished, the rollers are removed from the apparatus X.

It should be apparent that the process described above is in terms of copper plating. If chromium plating is utilized, buffing is not done. It should be apparent that the construction of the above-described apparatus could be varied without departing from the scope of the present invention. In particular, in the apparatus X the means to move the spindle in the axial direction is not limited to an air cylinder unit and various other methods such as a motor with pinion and rack, hydraulic motor and screw, and the combination of an air cylinder unit and linking device could be utilized. Furthermore, it is not necessary that the driving devices be provided on the apparatus X and could be provided on the apparatus Y. To the present invention it is only essential that the spindle be mounted in the mounting apparatus or cassette so that the spindle can move in the axial direction and so that the spindle can be driven by one of the above-described driving methods. Also, it is not necessary that the drive source for rotating the spindle be provided on the apparatus X and other driving means for rotating the spindle than those specifically described above could be utilized.

It should be apparent to those skilled in the art that the above described embodiment is merely illustrative of but one of the many possible specific embodiments which represent the applications and principles of the present invention. Numerous and various other arrangements can be readily devised by those skilled in the art without departing from the spirit and scope of the invention.

I claim:

1. A plating method for plating only the outer circumferential surface of a hollow roller utilizing a pretreatment device, an etching device, an after-treatment device and an electric metal plating device, said method comprising the steps of:

mounting the roller in a cassette wherein the cassette comprises:

a pair of lifting frames;

a pair of rotary spindles facing each other and rotatably coupled to the lifting frames such that at least one of the spindles are axially movable;

a pair of electrically conductive members provided one on each of said pair of spindles capable of supporting said roller by engaging with hollow ends of the rollers; and a pair of leakage-proof prevention caps provided one on each end of the pair of spindles for engaging with said hollow roller and for preventing liquid from leaking to the inside of said roller when the caps engage with the hollow end of the roller;

conveying the cassette to and mounting the cassette on successively, a tank of each of said pretreatment, etching, after-treatment and electric metal plating devices such that at least a part of the roller is immersed in a solution in the tank;

rotating the roller during pretreatment, etching, after-treatment and electric metal plating;

dismounting the cassette from the tank of said electric metal plating device;

conveying the cassette to a roller removal location; and removing the roller from the cassette.

2. A cassette for use in a process for plating only the outer circumferential surface of a hollow roller including pretreatment, etching, after treatment and electric metal plating, and wherein said cassette is conveyed to and mounted on successively a tank of pretreatment, etching, after-treatment and electric metal plating devices, said cassette comprising:

a pair of lifting frames;

a pair of rotary spindles, facing each other and rotatably coupled to the lifting frames such that at least one of the spindles are axially movable;

a pair of electrically conductive members provided one on each side of said pair of spindles capable of supporting said roller by engaging with hollow ends of the rollers; and a pair of liquid leakage-proof prevention caps provided one on each of the pair of spindles for engaging with said hollow roller and for preventing liquid from leaking inside of said roller when the caps engage with the hollow ends of the roller, said liquid leakage-proof prevention caps being provided on said spindles such that said liquid leakage prevention caps are axially movable.

* * * * *